United States Patent [19]

Eldridge et al.

[11] Patent Number: 4,880,500

[45] Date of Patent: Nov. 14, 1989

[54] STATIONARY CERAMIC COUCH DEVICE WITH WATER SPRAY CLEANING NOZZLES

[75] Inventors: Gerald E. Eldridge; Gary A. Visseau, both of Thunder Bay, Canada

[73] Assignee: Eldridge, Visseau Incorporated, Thunder Bay, Canada

[21] Appl. No.: 236,304

[22] Filed: Aug. 24, 1988

Related U.S. Application Data

[63] Continuation of Ser. No. 60,158, Jun. 10, 1987, abandoned.

[30] Foreign Application Priority Data

Jun. 19, 1986 [CA] Canada ..... 511990

[51] Int. Cl.[4] ..... D21F 1/52; D21F 1/34

[52] U.S. Cl. ..... 162/279; 162/275; 162/306; 162/352; 162/374

[58] Field of Search ..... 162/352, 374, 306, 363, 162/364, 371, 353, 275, 279

[56] References Cited

U.S. PATENT DOCUMENTS

| | | | |
|---|---|---|---|
| 2,408,176 | 9/1946 | Proulx | 162/374 |
| 2,712,776 | 7/1955 | Wagenknecht | 162/374 |
| 2,728,273 | 12/1955 | Javid | 162/374 |
| 2,976,925 | 3/1961 | Youngchild | 162/374 |
| 3,022,821 | 2/1962 | McArdle | 162/374 |
| 3,441,476 | 4/1969 | Schiel | 162/306 |
| 3,758,380 | 9/1973 | Hawkings | 162/306 |
| 3,836,428 | 9/1974 | McConaughy | 162/374 |
| 3,846,233 | 11/1974 | Kankaanpaa | 162/301 |
| 4,113,557 | 9/1978 | Kankaanpaa | 162/306 |
| 4,285,768 | 8/1981 | Schiel | 162/301 |
| 4,484,981 | 11/1984 | Fuchs et al. | 162/352 |

FOREIGN PATENT DOCUMENTS

| | | | |
|---|---|---|---|
| 2131984 | 2/1972 | Fed. Rep. of Germany | 162/374 |

*Primary Examiner*—Karen Hastings

*Attorney, Agent, or Firm*—John A. Baker

[57] ABSTRACT

A papermaking machine is modified by replacing a conventional rotatable couch roll by a stationary couch device that still serves the essential functions of the roll, namely dewatering of the furnish carried by the web and modification of the direction of travel of the web to turn it down towards the main drive roll. This stationary device is made of an abrasion resistant ceramic material and has a member with a convexly curved upper surface on which the web slides. Water is sucked from the furnish by a vacuum applied through perforations in the member. The majority of these perforations preferably take the form of slots that extend obliquely to both the transverse extent of the machine and the direction of web travel. The arrangement permits easier and more effective maintenance of the vacuum than with a couch roll and more efficient dewatering, with no rewetting of the web or furnish when leaving the couch device.

6 Claims, 4 Drawing Sheets

STATIONARY CERAMIC COUCH DEVICE WITH WATER SPRAY CLEANING NOZZLES

This application is a continuation of application Ser. No. 060,158, filed June 10, 1987, now abandoned.

BACKGROUND TO THE INVENTION

This invention relates to a stationary couch device for replacing the rotating couch roll in a papermaking machine of the type in which a "furnish" of paper stock is formed on a "wire" or endless fabric web, e.g. a Fourdrinier or Former type of papermaking machine.

In a typical such machine, the couch roll, usually situated at the downstream end of the machine, serves the dual purposes of (i) modifying the direction of the web on which the furnish is carried and (ii) extracting additional water from such furnish. Downstream of the couch roll the web passes over a main drive roll and is returned along the underside of the machine to receive further paper stock at the upstream end. Before the web reaches the drive roll, the furnish is removed from it by a pickup roll for transfer to a press section.

PRIOR ART

A typical couch roll is made of steel and contains a large number of relatively small holes. The inside of the roll is connected to a vacuum source, stationary seals being provided for the purpose of restricting the vacuum to the portion of the periphery of the roll in contact with the web at any given time. This use of stationary seals inside a roll rotating at relatively high speed presents a number of practical problems. The efficient maintenance of a vacuum at the leading and trailing edges (i.e. where the web first contacts the roll and where it separates from the roll) is so difficult that it has become common practice to restrict the high vacuum to the central portion of the area of contact between the web and the roll, while subjecting the leading and trailing portions to only a lower vacuum. Also substantial rewetting of the web and furnish can occur as the machine speed is increased due to centrifugal throw off from the rotating roll.

It is known to use a stationary suction device over which the web slides. For example, U.S. Pat. No. 3,758,380 issued Sept. 11, 1973 to Hawkings shows a suction box perforated with holes and located after a couch roll and before a drive roll. The surface of this suction box that is in contact with the web is made of a ceramic material, i.e. silicon carbide, but it is flat and serves only for additional dewatering of the furnish. It does not modify the direction of travel of the web and a conventional couch roll is still required for this purpose.

SUMMARY OF THE INVENTION

In contrast to this arrangement, the present invention relates to a stationary device that both dewaters and modifies the web direction, hence allowing the couch roll to be entirely dispensed with. In order to achieve the necessary modification of the direction of web travel, the device according to the invention includes a member having a convexly curved upper surface in contact with the web. Since the web is in tension and slides on this curved upper surface at high speed (typically 4,500 ft/min), the material of this surface needs to be highly resistant to abrasion. Preferred for this purpose is a ceramic material known as zirconia oxide ceramic. Another advantageous attribute of this material is that its coefficient of thermal expansion is close to that of the steel of the vacuum box to which it is to be secured. This similarity of thermal expansion facilitates maintenance of the alignment of the parts during use.

Hence, in its broad aspect, the invention consists of a member of abrasion resistant ceramic material for use with a vacuum box in a papermaking machine, said member having a first surface that is straight and elongate in one direction and convenxly curved in a second direction transverse to the first direction, with perforations extending between said first surface and a second surface of the member.

To achieve its dewatering function, this second surface of this member will be connected to a vacuum box. The perforations extending through the member will enable the vacuum beneath to suck water out from the furnish on the web above it.

In the preferred form of the invention these perforations take the form of elongate slots the majority of which extend obliquely both to the direction of travel of the web and to the transverse extent of the machine.

DETAILED DESCRIPTION OF THE PREFERRED EMBODIMENTS

Figure 1:
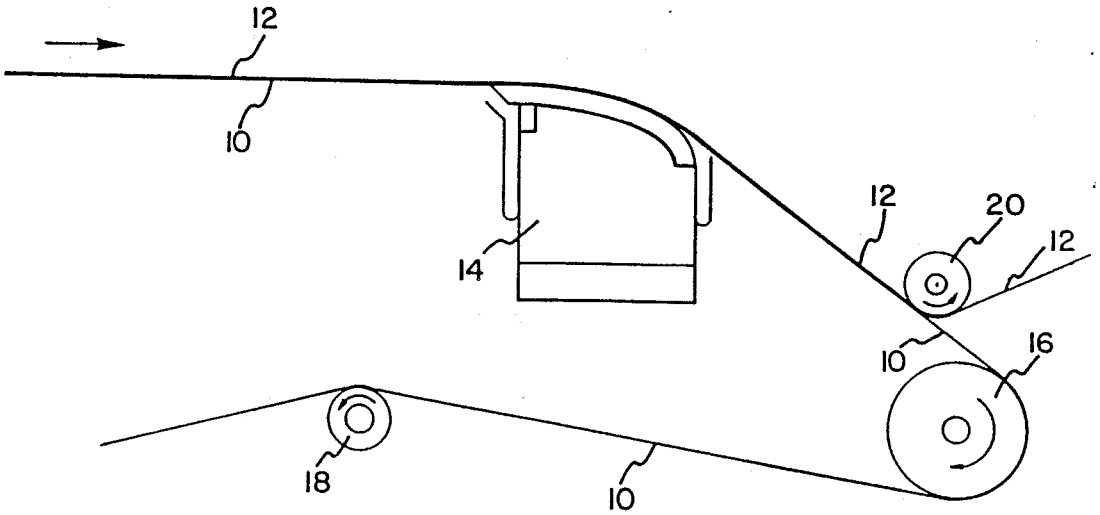
FIG. 1 is a diagrammatic side view of the downstream portion of a Fourdrinier type papermaking machine incorporating a stationary couch device according to a preferred embodiment of the present invention.

FIG. 1 shows a web 10 carrying the furnish 12 from the upstream parts of a Fourdrinier papermaking machine (not shown) past a stationary couch device 14 according to the present invention. The web 10 returns to the upstream end of the machine via a main drive roll 16 and a number of other rolls, of which only the roll 18 is shown. The furnish 12 is separated by a conventional pick-up roll 20.

Figure 2:
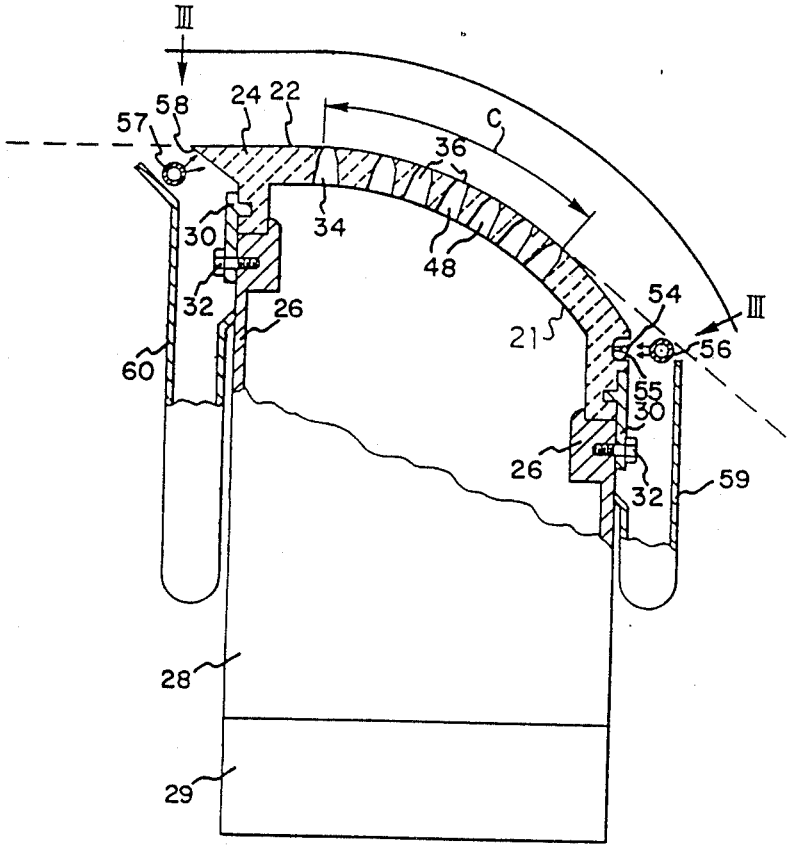
FIG. 2 is a partly cut away view on a larger scale of the couch device of FIG. 1.

Details of the device 14 are shown in FIG. 2. The web-contacting surface 22 is defined by a curved member 24 of abrasion resistant ceramic material of the type explained above, which member is secured to the steel walls 26 of an otherwise conventional vacuum discharge pump 29. This connection is made by steel members 30 and bolts 32. If desired, the member 24 can also be supported at a location intermediate the walls 26 by an intermediate support (not shown) connected to the vacuum box 28.

The member 24 is made of a solid material which is continuous from the web-contacting surface 22, which is a first major surface of member 24, to an opposite second major surface 21 of member 24 which is in communication with the vacuum box 28.

Figure 3:
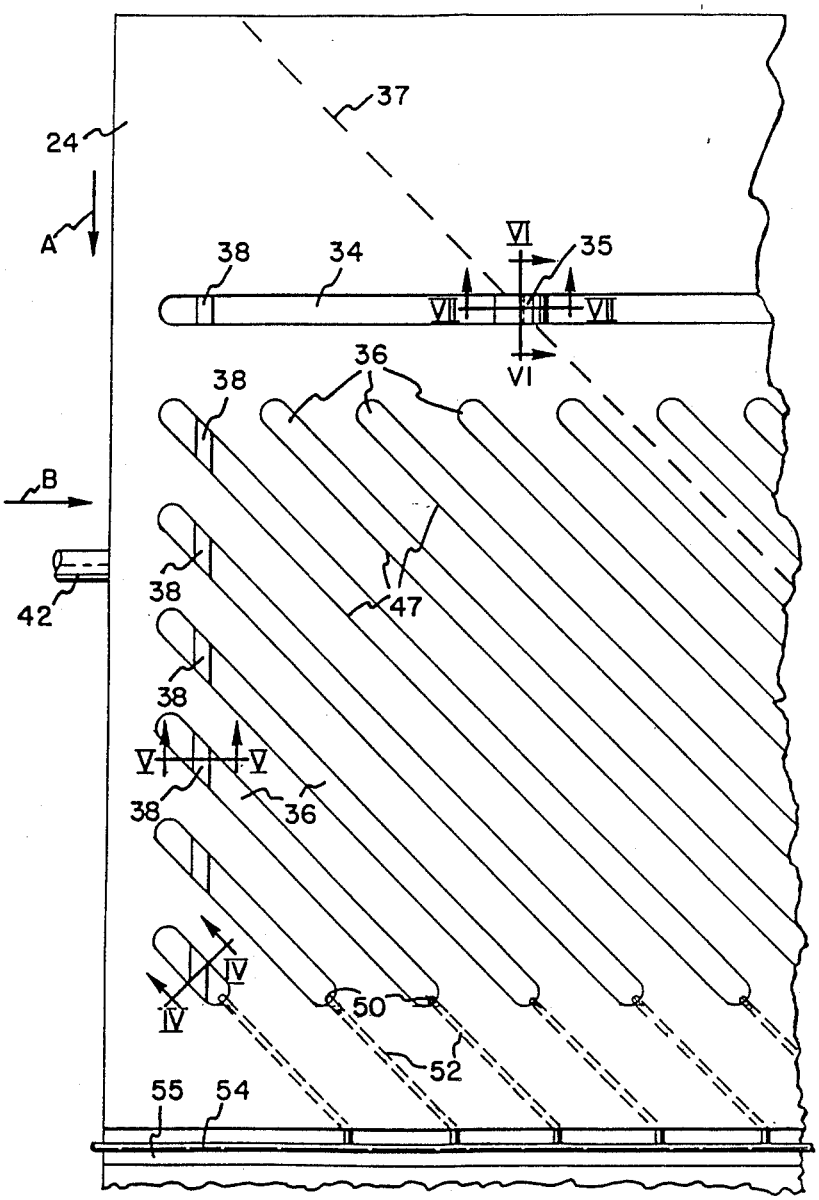
FIG. 3 is a view taken on the line III—III in Figure 2.
Figure 7:
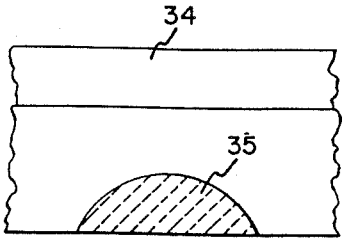
FIG. 7 is a section on VII—VII in FIG. 3.

As shown in FIG. 3, the member 24 is formed with one slot 34 that extends in the direction B, i.e. transversely across the member in relation to the direction A of web travel, and a series of slots 36 that extend obliquely to both directions. The member 24 will extend across the entire width of the machine (which in a typical machine could be about 285 inches), while its dimension in the travel direction A could conveniently be of the order of 18 inches. Thus, it will be realised that FIG. 3 shows only a small portion of one end of the member 24. For practical manufacturing reasons the member 24 will normally be cast as a series of separate pieces that are assembled and accurately aligned with each other in the machine, such alignment being maintained by the bolts 32 and steel members 30 which extend for the full width of the machine. While the member 24 can be divided into separate pieces along any lines found most convenient, it is believed that division lines that extend parallel to and between a pair of slots 36 (e.g. as designated by the broken line 37) will present the least difficulty in achieving accurate alignment of the pieces. To maintain structural integrity, the two inward edges of the slot 34 at the division line 37 will be joined by a ceramic bridge 35 that curved in the transverse direction (FIG. 7) to facilitate disposal of fines.

Figure 4:
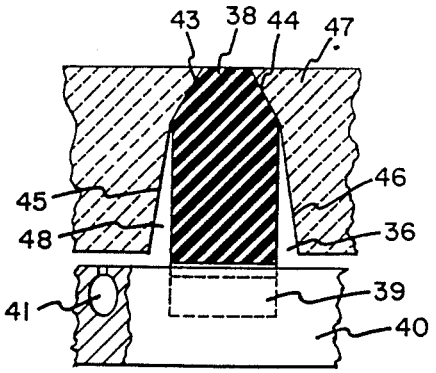
FIG. 4 is a section on IV—IV in FIG. 3.
Figure 5:
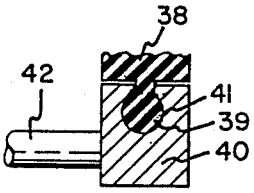
FIG. 5 is a section on V—V in FIG. 3.
Figure 6:
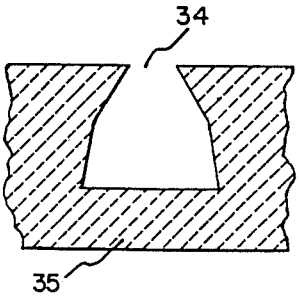
FIG. 6 is a section on VI—VI in FIG. 3.

As best seen in FIGS. 4 and 5, each slot is provided with a sealing deckle 38 that can be adjusted in the longitudinal direction of the slot 34 or 36 to coordinate the effective edge of the vacuum to the actual edge of the furnish carried by the web. Each deckle 38 is moved along its respective slot by a control member 40 that can be moved in the direction B by a rod 42 that is connected to a conventional deckle adjustment mechanism (not shown). In the case of those deckles situated in an oblique slot 36, some longitudinal movement in the direction A must accompany the oblique movement along the slot. This is enabled by a sliding connection between the deckel 38 and the control member 40, i.e. a downward extension 39 of the deckel 38 that slides in a slot 41 in the member 40.

FIG. 4 also shows the preferred cross-sectional shape of each slot 36 (slot 34 being similar), namely with relatively sharply inwardly slanting upper portions 43 and 44 that respectively extend into less sloping portions 45 and 46. This shape provides a doctoring blade effect at the acute angle edge 47 and a diverging lower area 48 that is useful for disposal of the fines that will be sucked through the web by the vacuum and tend to plug up the slots if not afforded ample space to travel down into the vacuum box 28.

To further facilitate this disposal of fines each slot 36 is provided with a water spray that extends along its length (in a slightly downward direction to minimise rewetting of the furnish carried by the web) from a nozzle 50 situated at the end of a hole 52 extending through the member 24 from a transversely extending header 54 located near the downstream edge of the member 24 in a groove 55 that is itself kept clean by water sprays from a pipe 56. Similar water sprays from a pipe 57 serve to dislodge fines collected from the leading edge 58 of the member 24. Troughs or "savealls" 59, 60 serve to collect the water and fines falling from these areas.

The double arrow C designates the vacuum surface, i.e. the effective working surface of the member 24. The area of this surface is greater than in a conventional couch roll, which results in improved dewatering. Moreover, due to the stationary nature of the device 14 and the resulting ease of maintaining a vacuum therein, a high vacuum e.g. as high as 24" of mercury, can be applied through all parts of all the slots.

The transverse slots 34 can be dispensed with, if dimpling (i.e. a tendency for the web to be sucked into a slot in a line across the machine) is encountered. This tendency may depend on factors such as the dimensions of the machine parts and the speed of operation of the machine. What is important is that the majority of the slots extend obliquely. The oblique slots are illustrated as extending at 45° to the transverse direction, but this angle is not critical, and can be varied for convenience of manufacture. The advantage of arranging the majority of the slots obliquely is a reduction of dimpling, while nevertheless maintaining the doctoring effect afforded by the acute angle edges 47.

As the speed of the web increases, the width of each slot can also increase to maintain the dewatering efficiency of the machine.

A further important advantage of using a stationary couch device is the avoidance of rewetting of the web and furnish due to the centrifugal throw off of water that occurs with a rotating couch roll, especially one rotating at high speed.

We claim:

1. In the paper forming section of a papermaking machine having a first end, a second end, a porous belt on which a fibrous web is formed at said first end and removing means for removing said fibrous web from said paper forming section at said second end; a couch roll replacement device for dewatering said fibrous web and for changing the direction of travel of said porous belt and said fibrous web, said couch replacement device being located in said paper forming section adjacent to and upstream of said removing means and comprising:

a solid abrasion resistant ceramic element having a continuously convex upper surface in contact with the underside of said porous belt, said convex upper surface thereby changing the direction of travel of said porous belt and said fibrous web, the ceramic element further comprising a lower surface and a plurality of elongated slotted apertures, some of said plurality of elongated slotted apertures terminating directly adjacent the side edges of the ceramic element, said elongated slotted apertures connecting said upper surface with said lower surface;

water spraying means associated with each elongated slotted aperture of said plurality of elongated slotted apertures for spraying water into each of said elongated slotted aperture for dislodging fines collected therein:

said water spray means comprising a plurality of nozzles wherein at least one nozzle is associated with each of said elongated slotted apertures, a header located near an edge of said ceramic element and a plurality of holes in said ceramic element for communicating said header with said plurality of nozzles.

vacuum box means having a single vacuum chamber connected to said ceramic element for providing a uniform high vacuum which acts through all of said plurality of elongated slotted apertures and through said porous belt on said fibrous web to extract water therefrom; and sealing deckle means located along each side of the ceramic element, said deckle means cooperating with said elongated slotted apertures which terminate directly adjacent the side edges of said ceramic element so as to seal off any portion of said elongated slotted apertures not directly under said fibrous web so as to maintain said uniform high vacuum within the ceramic element and vacuum box combination so that said high vacuum is applied uniformly through all of said plurality of said elongated slotted apertures to said fibrous web.

2. The device of claim 1, wherein at least a majority of said plurality of elongated slotted apertures extend obliquely to the direction of travel of the porous belt and the fibrous web.

3. The device of claim 1, wherein each elongated slotted aperture of said plurality of elongated slotted apertures has a transverse cross-section that diverges from said upper surface to said lower surface.

4. The device of claim 2, wherein said each elongated slotted aperture of said plurality of elongated slotted apertures has an acute angle doctoring edge at said upper surface.

5. The device of claim 1, wherein said vacuum box means is made of a material having a predetermined coefficient of thermal expansion and wherein said abrasion resistant ceramic element has a coefficient of thermal expansion which is similar to said predetermined coefficient of thermal expansion.

6. The device of claim 1 wherein said water spray means is structured and arranged to spray water into each of said elongated slotted apertures in a downward direction away from said web so as to minimize wetting thereof.

* * * * *